US007086396B2

(12) United States Patent
Waters

(10) Patent No.: US 7,086,396 B2
(45) Date of Patent: Aug. 8, 2006

(54) HEATING APPARATUS

(76) Inventor: Michael Waters, 372 Bateman Cir. North, Barrington Hills, IL (US) 60010

( * ) Notice: Subject to any disclaimer, the term of this patent is extended or adjusted under 35 U.S.C. 154(b) by 0 days.

(21) Appl. No.: 10/776,966

(22) Filed: Feb. 11, 2004

(65) Prior Publication Data

US 2005/0175950 A1 Aug. 11, 2005

(51) Int. Cl.
*F24C 15/22* (2006.01)

(52) U.S. Cl. ..... 126/92 B; 126/92 AC; 165/154; 165/169

(58) Field of Classification Search ..... 126/85 R, 126/90 R, 92 R, 92 AC, 92 B, 91 A, 92 C, 126/85 A, 110 B, 110 C, 110 D, 116 R; 122/155.1–155.5, 122/160, 48; 165/135, 154, 169; 392/422, 392/423

See application file for complete search history.

(56) References Cited

U.S. PATENT DOCUMENTS

| | | | | |
|---|---|---|---|---|
| 412,744 | A | 10/1889 | Green | |
| 793,883 | A | 7/1905 | Köneman | |
| 849,323 | A | 4/1907 | Blanchard | |
| 910,345 | A | 1/1909 | Akin | |
| 913,068 | A | 2/1909 | Hoor | |
| 1,232,457 | A | 7/1917 | Campbell | |
| 1,503,198 | A | 7/1924 | Majcen | |
| 1,939,549 | A | 12/1933 | Gulley | |
| 2,130,086 | A | 9/1938 | Hart | |
| 2,514,372 | A | 7/1950 | Cartter et al. | |
| 2,662,966 | A | 12/1953 | Bruchhausen | |
| 2,700,970 | A | 2/1955 | Cartter | |
| 2,731,009 | A | 1/1956 | Pocrass et al. | |
| 2,950,713 | A * | 8/1960 | Sterick | 126/85 R |
| 2,972,474 | A | 2/1961 | von Linde et al. | |
| 2,985,137 | A | 5/1961 | Horne | |
| 3,251,355 | A | 5/1966 | Keating | |
| 3,314,411 | A | 4/1967 | Power | |
| 3,359,964 | A | 12/1967 | Wilson, Sr. | |
| 3,429,306 | A | 2/1969 | Thompson | |
| 3,459,961 | A | 8/1969 | Ravas | |
| 3,503,379 | A | 3/1970 | Kuhn et al. | |
| 3,537,431 | A | 11/1970 | Ramey | |
| 3,934,572 | A | 1/1976 | Teague, Jr. | |
| 4,364,372 | A | 12/1982 | Johnson | |
| 4,449,034 | A | 5/1984 | Taniguchi | |
| 4,587,949 | A | 5/1986 | Schott | |
| 4,741,323 | A | 5/1988 | Pivonka | |
| 4,893,609 | A | 1/1990 | Giordani et al. | |
| 4,958,619 | A | 9/1990 | Kardas | |
| 5,056,502 | A | 10/1991 | Eyzaguirre et al. | |
| 5,479,916 | A | 1/1996 | Shimek et al. | |

(Continued)

FOREIGN PATENT DOCUMENTS

| | | |
|---|---|---|
| BE | 565153 | 7/1960 |

(Continued)

*Primary Examiner*—Jiping Lu
(74) *Attorney, Agent, or Firm*—Fitch, Even, Tabin & Flannery

(57) ABSTRACT

A heating apparatus is provided that is optimized in terms of its heating efficiencies and wind proofing against flame out. The heating apparatus includes a heating head and a burner assembly for igniting fuel from a fuel source. The heating head has a dual-walled construction to form several flue chambers with the inner wall preferably being insulated to maximize heat transfer to the outer wall from combustion gases flowing through the flue chambers. The flue chambers can also be formed to be substantially isolated from each other and configured to generate turbulent gas flow therein for maximum heat transfer to the outer wall.

10 Claims, 3 Drawing Sheets

U.S. PATENT DOCUMENTS

| | | | | |
|---|---|---|---|---|
| 5,807,098 | A | 9/1998 | Deng | |
| 5,964,233 | A | 10/1999 | Clark et al. | |
| 6,102,031 | A | 8/2000 | Waters | |
| 6,164,273 | A * | 12/2000 | Waters | 126/92 B |
| 6,192,878 | B1 | 2/2001 | Waters | |
| 6,422,232 | B1 | 7/2002 | Ashton et al. | |
| 6,470,877 | B1 | 10/2002 | Waters | |
| 6,651,647 | B1 | 11/2003 | Waters | |

FOREIGN PATENT DOCUMENTS

| | | |
|---|---|---|
| EP | 976979 | 2/2000 |
| GB | 2154728 | 9/1985 |
| IT | 526841 | 5/1955 |
| JP | 07-286736 | 10/1995 |
| JP | 09-196381 | 7/1997 |
| JP | 09-303784 | 11/1997 |
| WO | WO-98/58211 | 12/1998 |

* cited by examiner

HEATING APPARATUS

FIELD OF THE INVENTION

The present invention generally relates to a heating apparatus and, more particularly, to a high efficiency heating apparatus for warming an area thereabout.

BACKGROUND OF THE INVENTION

LP propane or natural gas fueled heaters such as patio heaters are available in both free-standing and built-in configurations, and are primarily sold for commercial applications. For example, patio beaters have become especially popular in recent years in areas such as the Southwest where no smoking laws are being applied to taverns and bars forcing patrons outdoors to smoke which can be especially inconvenient during cold nights. Patio heaters can be utilized to provide warmth in preselected outdoor areas making it much more comfortable for smokers, and for those who like to be outdoors.

Free-standing patio heaters that can be readily moved from location to location to heat preselected areas typically have a base that is sized to contain a fuel tank therein and an elongate hollow support standard or post projecting upward therefrom to a burner assembly housing in which air is heated by combustion of the fuel gases from the tank in the base. The burner assembly housing has an emitter comprised of a cylindrical wall provided with apertures to provide for the escape of the hot gaseous products of combustion in the housing. The flow of hot gases through the wall apertures heats the wall so that the wall emits radiant heat. A relatively large dome-shaped reflector hood is attached on top of the housing and opens downwardly for reflecting heat emanating from the housing generally downwardly about the standard of the patio heater. In the built-in configuration which typically will not be moved after the unit is installed, the heater is connected to a source of gas, such as provided by a gas utility company, thus eliminating the need for the base so that the standard extends all the way from the ground up to the burner assembly housing. In each of the free-standing and built-in configurations, the burner assembly housing and reflector dome have substantially the same construction.

A shortcoming of patio heaters using apertured emitters is their relatively poor heating efficiency. Currently, about ten percent of the input energy in these patio heater is converted to infrared heat energy. Generally, the burner flames and the hot gaseous combustion products generate heat, and the current emitter heads are not in heat conducting relation with these heat sources for sufficient time as the heat energy passes through the apertured walls thereof. In other words, the apertured walls lacked sufficient surface area in optimized heat transfer relation with the heat generated by the burner assembly. Even in prior elongated and fluted solid heater casing constructions, see U.S. Pat. No. 2,950,713 to Sterick, the hot gaseous flow is not well confined for maximized heat transfer to the casing. In addition, heat is lost to the interior of the casing in the '713 patent further reducing heat transfer efficiencies. Accordingly, the heater of the '713 patent is not well-suited for high efficiency heating operations.

In conventional patio heaters, the apertures included in the cylindrical wall of the emitter have been included in an effort to provide adequate transmission of heat from the hot combustion gases to the emitter walls so that it can heat up and radiate heat to the surroundings. Although the apertured cylindrical walls on conventional heaters generate some radiant heat upon being heated up by the passing burner gases, the amount is relatively limited in reality.

The poor heating efficiency is attributable in part to the use of stainless steel and the like as the structural material of the apertured emitter wall of the conventional patio heaters. What has not been previously appreciated is that such emitters generate radiant heat predominantly at relatively shorter wavelengths of the electromagnetic spectrum that are not very efficient for heating bodies and or apparel worn by people in the vicinity of the patio heater. Stainless steel, when heated in conventional patio heaters, gives off a noticeably visible bright orange-colored glow, corresponding to considerable radiant energy being released at relatively shorter wavelengths of the electromagnetic spectrum. The rainbow of colors commonly referred to as visible light falls in the portion of the electromagnetic spectrum with wavelengths of 400 nm to 700 nm. However, it has not been previously appreciated that the radiant energy generated by the heated stainless steel emitters includes only a small proportion falling in longer wavelength bands, such as far infrared waves. For instance, it was not previously appreciated that only about 10% of the radiant energy of conventional patio heaters made with apertured stainless steel emitters is in the infrared (IR) region.

Infrared radiation is the region of the electromagnetic spectrum that extends from the visible region (0.7 μm) to 1000 μm in wavelength. Infrared waves are invisible to the human eye. Infrared waves include thermal radiation. For instance, burning charcoals may not give off visible light, but they do emit infrared radiation which is felt as heat by human skin. Radiant energy in the far infrared band (10 μm to 1000 μm), in particular, is high in such thermal radiation.

As another drawback associated with conventional patio heaters, the apertured emitters used in conventional patio heaters have poor wind tolerance. In particular, the emitter burner flame in conventional patio heaters gets extinguished by wind or even a slight breeze of sufficient strength entering the emitter housing through the grid holes of the conventional radiant emitter grid component. This leads to the loss of the heating effect until the burner flame can be re-ignited. The cost of many conventional patio heaters has been increased due to the necessity of equipping them with automatic shut-off mechanisms for handling inadvertent occurrences of flame-out at the burner assembly. As can be appreciated, a need also has existed for a more wind tolerant patio heater.

Accordingly, a need exists for a heater with increased heating efficiency. Moreover, a need also exists for a patio heater type heating apparatus, which can deliver a desired amount of heating at lower energy costs. Further, there is a need for a more wind tolerant patio heating apparatus.

SUMMARY OF THE INVENTION

In accordance with the present invention, a high efficiency heating apparatus is provided that includes a heating head having flue chambers for the hot gases of combustion generated by operation of the burner assembly. In one form, the flue chambers are formed by external and internal wall portions of the head, and insulation material is provided along the internal wall portions so that heat transfer from the hot combustion gases to the external wall portions is maximized. In another form, the flue chambers are substantially isolated from each other and are configured to confine gas flow such that turbulent flow conditions are generated therein to maximize heat transfer from the gas to the heating head. In a preferred form, the heating apparatus is used as a patio heater with the heating head mounted on top of an elongate support member or pole. With the flue chambers as described above, the heating head can be maximized in size along its longitudinal axis allowing the pole length to be kept to a minimum.

In another aspect, the outer wall portion of the heating head are of a predetermined material selected to optimize the generation of infrared (IR) heat energy when heated. With heat transfer to these walls maximized, the axial head size can be increased, as earlier mentioned. Further, with the IR optimized outer wall material, e.g. aluminized or carburized steel, the head can be axially longer and still generate heat energy in the desired infrared region.

In one preferred form, the heating head includes a tubular shaped inner wall having a central longitudinal axis and an outer surface facing a generally tubular outer wall disposed coaxially outside the inner wall. More specifically, the general tubular outer wall includes an undulated configuration thereof in a direction transverse to the longitudinal axis. The undulated shape comprises alternating upraised portions and intervening lands, where the upraised portions have interior surfaces and the lands contact the outer surface of the inner wall effective to form a plurality of substantially isolated flue chambers about the heating head. These flue chambers function to funnel up hot gases generated by the burner assembly through the chambers until vented out an open upper end of the housing.

It is preferred that the outer wall becomes heated by the hot flowing gases of combustion in the flue chambers such that it emits radiant energy that is predominantly of infrared wavelength from its exterior surface into the surrounding area. To this end, the preferred heating apparatus is an excellent infrared radiation source in that the outer wall of the heating head is of a material having high emissivity properties in the region of infrared wavelengths. Moreover, since the outer wall is undulated in configuration, it effectively offers an increased amount of surface area available to emit radiant energy into the surrounding area. These and other features of the preferred heating apparatus permit substantial infrared radiant energy to be emanated into the surrounding vicinity of the heater. Due the resulting increased heating efficiencies of the heating apparatus, lower feed gas requirements are needed to obtain a given amount of heating effect, which translates into lower operating costs for the heater. As a result, the gas orifices of the burner assembly can be smaller than the conventional 48 gauge orifices, e.g. 52 or 54 gauge, and the heat input energy can be significantly reduced such as by approximately 50% cover current patio heaters, e.g. from approximately 40,000 BTU/hr to approximately 20,000 BTU/hr.

The heating apparatus also is effectively wind-proofed because the outer wall feature of the housing that constitutes the radiant energy emitter of the burner assembly can be deployed as a substantially continuous solid member preferably with little or no aperturing thereof that would otherwise permit ingress of winds sufficient to put out the flames of the burner assembly or premature egress of combustion gases before they reach the open-ended top of the housing. In addition, the use of a solid, non-foraminous or essentially non-foraminous outer wall construction also creates narrow enclosed annuluses or isolated flue chambers between the inner wall and outer wall of the emitter which are relatively small in cross-section, to create turbulent, non-laminar flow in the combustion gases as they pass upward through the annular spaces away from the burner assembly. The turbulent flow created in the hot combustion gases increases the amount of heat transfer from the gases to the outer wall. As the annular spaces provided for channeling combustion gases up through the housing are relatively narrow and relatively air-tight, and not wide in cross-section, the hot combustion gases have no or little opportunity to spread out and assume a laminar flow profile as they are funneled up the individual annular spaces until escaping at the respective open tops of the annular spaces which can be located immediately below a reflector dome or lid when the heating apparatus is used as a patio heater, for instance.

As previously mentioned, the outer wall of the heating head is preferably substantially covered with or formed of a material such as aluminum or a carburized surface region, which is highly reflective to IR. Consequently, even though the outer wall of the housing is undulated in shape, IR heat energy is radiated outward away from the heated housing, or otherwise is reflected off the facing sides of neighboring flutes or upraised portions in high percentages until the reflected IR energy travels into the surrounding area.

In one particular aspect, the heating apparatus in accordance with the present invention emits a significant proportion, such as 50% or more, of its generated radiant energy as infrared radiation. Moreover, it also emits a significantly higher percentage, such as 30% or more, of the heat input into the heater apparatus as radiant energy in the infrared region of the electromagnetic spectrum, as compared to conventional patio heaters. This high level of IR radiant energy generated by the heaters of the invention is highly useful and efficient for heating the bodies and or apparel worn by persons and patrons located around the heater.

The inventive heating apparatus also is highly versatile, as it can be used indoors or outdoors, and in either free-standing or built-in configurations.

BRIEF DESCRIPTION OF THE DRAWINGS

Other features, objects, and advantages of the present invention will become apparent from the following detail description of preferred embodiments of the invention with reference to the drawings, in which.

Figure 1:
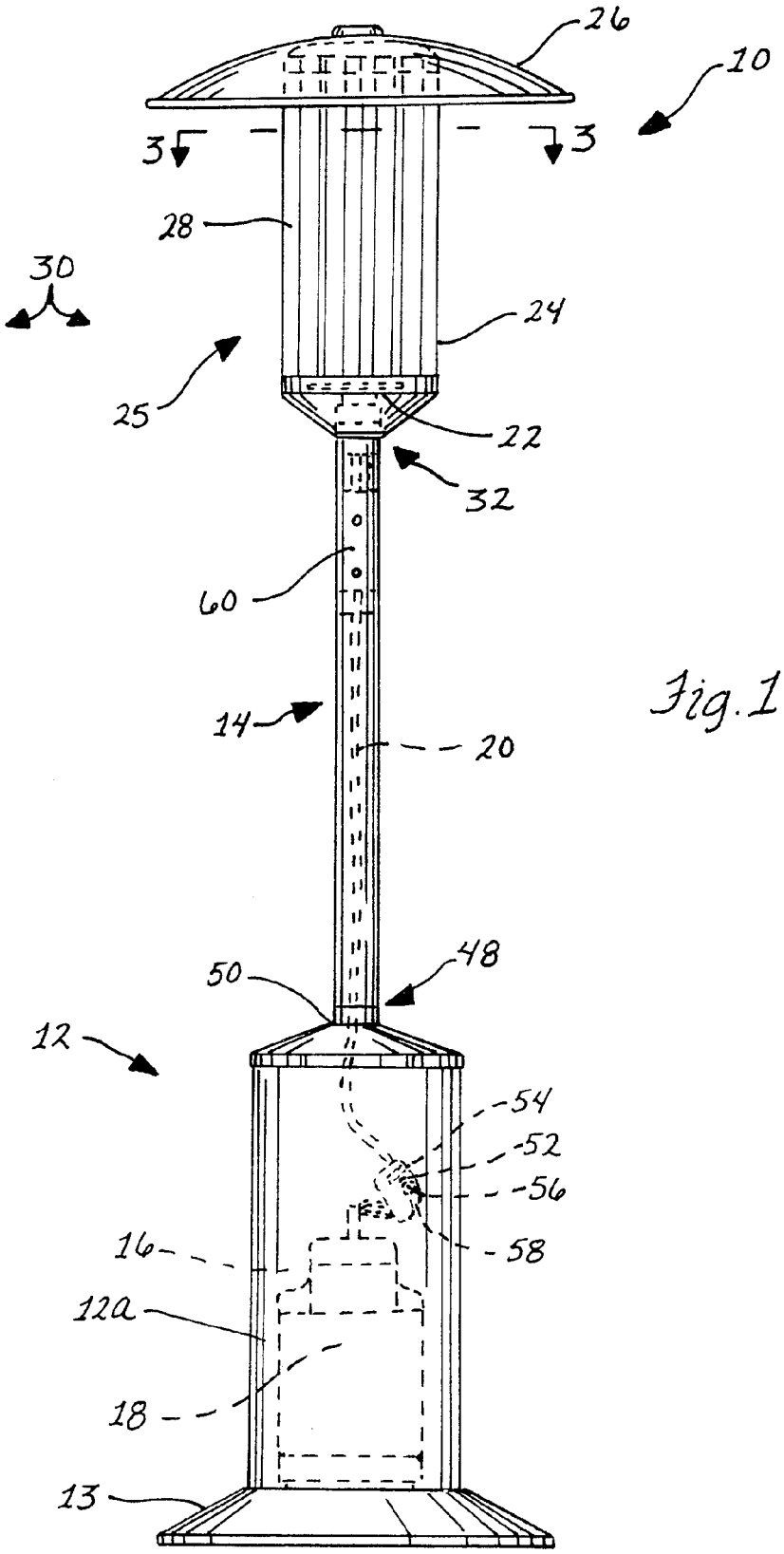
FIG. 1 is an elevational view of a heating apparatus in accordance with the invention showing a patio heater including an elongated heating head mounted on a support pole.

Skilled artisans will appreciate that elements in the figures are illustrated for simplicity and clarity and have not necessarily been drawn to scale. For example, the dimensions of some of the features shown in the figures may be enlarged relative to other elements to facilitate the discussion herein of the embodiments of the invention. Also, features in the various figures identified with the same reference numerals represent like features, unless indicated otherwise.

DETAILED DESCRIPTION OF THE PREFERRED EMBODIMENTS

In FIGS. 1–4, a high-efficiency heating apparatus in accordance with the present invention is illustrated. The heating apparatus 10 is adapted to utilize natural or LP gas as fuel to generate heated air by the hot gases of combustion and radiant infrared heat for keeping an area about the apparatus 10 heated. The apparatus 10 is often termed a "patio heater" as it is designed primarily for outdoor use such as during nighttime in patio areas outside of taverns and bars so that patron can spend time outdoors in a comfortable preselected area which is warmer than the colder outdoor temperature. As shown, the patio heater 10 has a base 12 at the bottom of elongate support member, post or standard 14. The base 12 has an interior space 16 for containing L.P. tank 18 therein. Alternatively, the heating apparatus 10 need not be in the form of a patio heater including the base 12 and standard 14 described above, and instead can be more simply a free standing heating unit such as a space heater or the like.

The base interior 16 can be sized so as to fit a standard 20 lb. LP cylinder 18 or other suitable sized cylinder therein. In one form shown in FIG. 1, the base 12 has an upper shroud portion 12*a* which is of a HDPE thermoformed material with the interior 16 cutout so as to snugly fit the LP tank 18 inside the base 12. A lower support flange 13 of steel material such as, for example, an 11 gage steel having a wall thickness of approximately 0.250 inch can be provided at the bottom of the upper shroud portion 12*a* of the base 12. As shown, the bottom support flange 13 has a larger diameter than the upper plastic portion 12*a* of the base 12 and supports the bottom of the tank 18 thereon in the base interior 16. Where the tank 18 is a standard 20 lb. LP cylinder, the diameter for the flange 13 at the bottom thereof can be, for example, approximately 20.60 inches with a height of approximately 2.50 inches.

Figure 2:
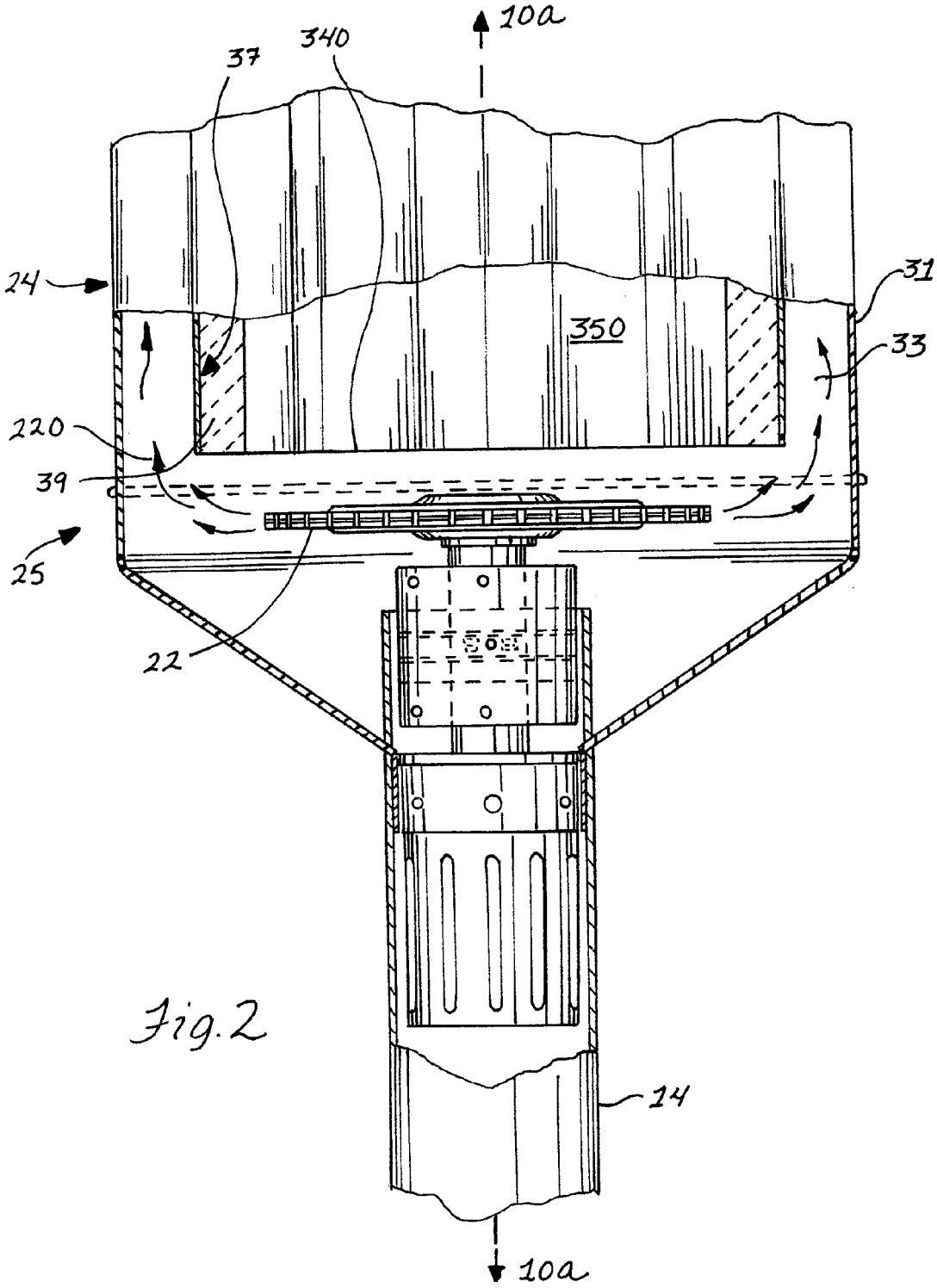
FIG. 2 is an enlarged elevational view, partially in section of the heating head showing its dual-walled construction and a burner assembly situated so that hot combustion gases flow through flue chamber formed between the head walls.

The standard 14, in one aspect is hollow so that a gas line 20 can be run therethrough from the tank 18 up to burner assembly 22 contained in a heating head or housing 24 therefor, as seen generally in FIG. 2. It is also contemplated that the heating apparatus 10 can be connected to an underground gas line such as provided by a gas utility with the standard 14 anchored in the ground and the gas line 20 connected to the underground utility line thus eliminating the need for the base 12 housing the LP tank 18.

In the apparatus 10, there is included a high efficiency radiant emitter system, generally designated 25, that maximizes the amount of heat emanating from the burner assembly housing 24 for a given amount of energy input that is used for heating of a preselected area about the apparatus 10. In this manner, the heat efficiency system 25 minimizes the amount of fuel that is consumed for heating of the area that is desired to be warmed.

Referring still to FIG. 1, there is shown the arrangement of a cover member portion 26 that is formed integrally with or otherwise attached in superimposed relation over the housing 24 for the burner assembly 22. The support standard 14, base 18, housing 24 and cover 26 are all aligned along a central, longitudinal vertical axis 10*a* of the heating apparatus 10. The cover member 26 serves primarily to protect the burner assembly housing 24 from exposure to the outdoor environment such as rain, snow, falling leaves, and so forth, and also reflects stray radiant heat that rises above the housing 24 back down around the support standard 14 and base 18 of the apparatus 10, and specifically about the apparatus vertical axis 10*a*. A vertical space is provided between the interior surface of the dome 26 and the upper surface of housing 24 to permit combustion gases to escape from an open top of the housing 24.

Figure 3:
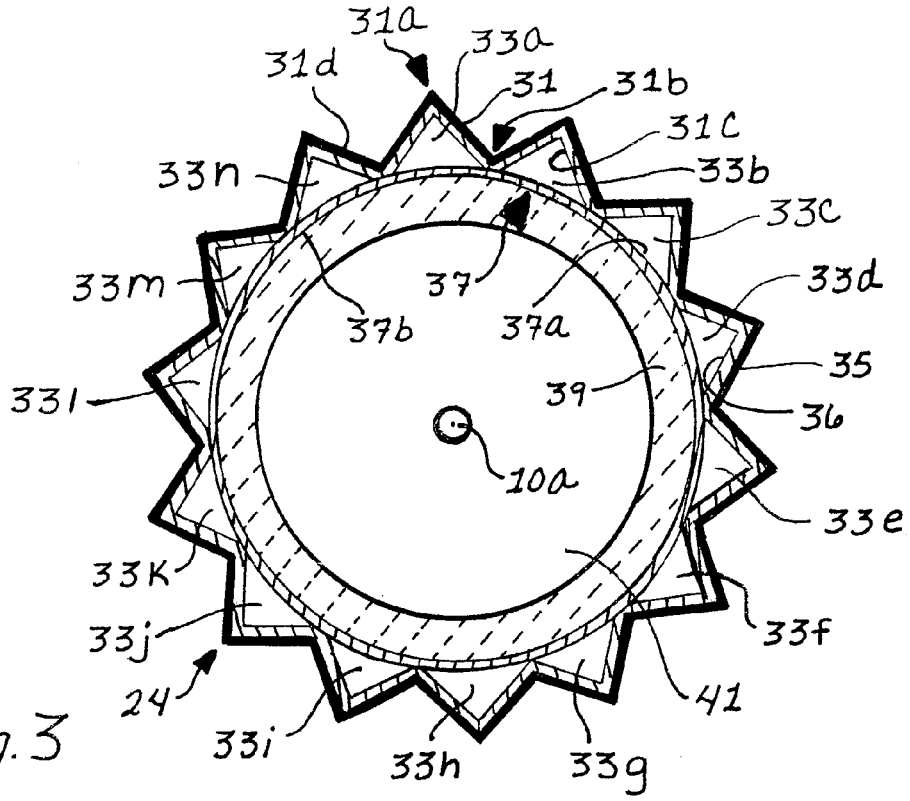
FIG. 3 is a sectional view taken along line 3—3 in FIG. 1 showing the flue chambers and one configuration for the outer wall of the heating head.
Figure 4:
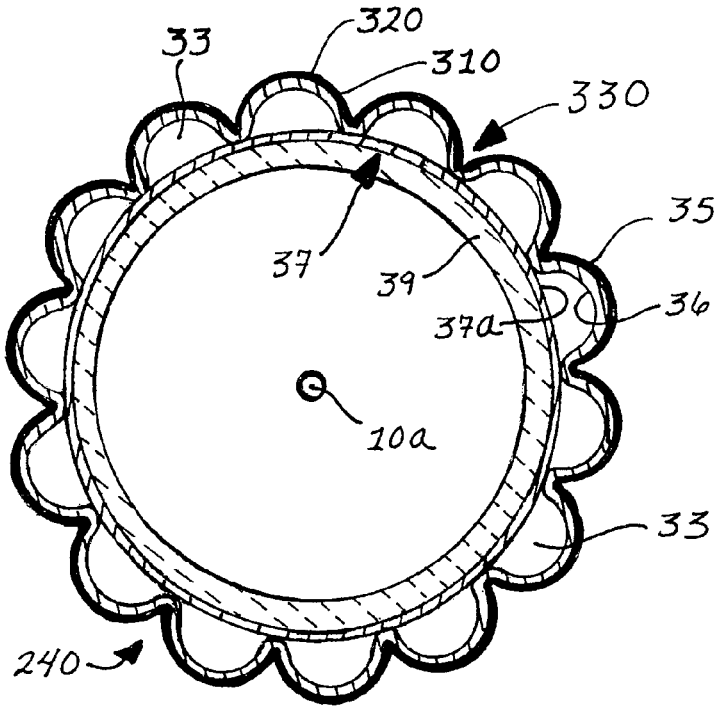
FIG. 4 is a sectional view of an alternative configuration for the heating head outer wall.

Referring now more specifically to FIGS. 2–4, the heat efficiency system 25 of apparatus 10 will be described now in more detail. The housing 24 has a unique construction that makes possible significantly increased heating efficiencies.

Referring to FIG. 3, the housing or heating head 24 for the burner assembly 22 has a dual-walled construction that preferably includes a tubular shaped inner wall 37 having the central longitudinal axis 10*a* extending through it and an outer surface 37*a* facing a generally tubular outer wall 31 disposed coaxially about the inner wall 37. The annulus between the head walls 31 and 37 is preferably formed into a plurality of flue chambers 33 as discussed in more detail hereinafter. To maximize heat transfer from the hot gases of combustion traveling through the flue chambers to the outer wall 31, insulative material 39 is provided along and preferably on the interior surface 37*b* of head inner wall 37. In this manner, heat energy otherwise lost in the inner space 41 of the head 24 is kept to a minimum, and heat transfer from the hot gases of combustion traveling through the flue chambers to the head outer wall is maximized. Preferably, the outer wall 31 has an undulated configuration in a direction transverse to the longitudinal axis 10*a*, as can be seen in FIGS. 3 and 4. Herein, the term undulated generally encompasses both smooth curves and sharp angels, or both, for the peaks or raised portions 31*a* described below.

The undulated shape of the outer wall 37 includes alternating peaks or upraised portions 31*a* and intervening valleys or lands 31*b*. Along the upraised portions 31*a* to the tips thereof, interior surfaces 31*c*, and outer surfaces 31*d* of the outer wall 31 are spaced radially outward from the outer surface 37*a* of inner wall 37. It is preferred that at the lands 31*b* of outer wall 31, the interior surface 31*c* will contact the outer surface 37*a* of the inner wall 37 at intermittent, circumferentially spaced locations around inner wall 37. Accordingly, the annulus between the walls 31 and 37 is divided into a plurality of separate, open-ended annular spaces or flue chambers 33*a*–*n*, which are substantially isolated from each other and defined between the interior surfaces 31*c* of the upraised portions 31 of outer wall 31 and the outer surface 37*a* of the inner wall 37. Thus, each flue chamber 33*a*–*n* is formed by portions of the outer and inner walls 31 and 37. Alternatively, these wall portions could be distinct from each other, although integral outer and inner walls 31 and 37 are preferred. Further alternatives would be to undulate the inner wall and keep the outer wall cylindrical, or have both walls include undulations as defined herein.

The inner wall can be formed of a generally rigid, corrosion resistant tubular material, such as stainless steel, which can have a generally smooth, cylindrical outer surface 37*a*. The annular spaces 33*a*–*n* function to funnel up hot gases of combustion 220 as shown in FIG. 4, which are generated by operation of the burner assembly 22 through the annular spaces until vented out an open upper end of the housing 24. The outer wall 31 becomes heated by the hot flowing gases 220 in the annular spaces 33*a*–*n*, such that it emits radiant energy which is predominantly of infrared wavelength from its exterior surfaces 31*d* into the surrounding area 30 shown in FIG. 1.

The size of the flue chambers 33 is such that turbulent gas flow is generated therein during typical heater operations such as with standard or even reduced burn rates at the burner assembly 22, as discussed hereinafter. Turbulent flow of the combustion gases provides for more thorough transfer of heat energy therefrom to the head outer wall 37. By way of example, the cross-sectional area of the flue chambers 33 can be approximately one inch square, to generate the desired turbulent flow therein.

The heating apparatus 10 herein is an excellent infrared radiation source in that the outer wall 31 of the burner assembly housing 24 is preferably of a material having high emissivity properties in the region of infrared wavelengths.

Moreover, since the outer wall 31 is undulated in configuration, it effectively offers an increased amount of surface area available to emit radiant energy into the surrounding area 30. These and other features of the inventive heating apparatus 10 permit substantial infrared radiant energy to be emanated into the surrounding vicinity of the heating apparatus 10.

With the optimized heat transfer characterized such as provided by the insulated and/or isolated flue chambers 33 described above, the heating head 24 can be extended in its axial length along the central axis 10*a*. Further, the use of IR-optimized material for the head outer wall 31 also enables the size of the head 24 to be maximized in the axial direction 10*a*. Lengthening the head 24 avoids excessive heating of the outer wall 31 that can generate wave lengths shorter than the infrared wavelengths that are desired. Accordingly, the longer head 24 herein will produce more usable heat energy by keeping the wavelength of the emitted energy longer and from a greater surface area along the long head 24 that will not get as hot as a shorter head would. By way of example, the head 24 herein can be provided with an axial length of approximately 24 inches. Where the head 24 is used in a patio heater, the longer head 24 also enables a shorter support pole, e.g. 16 inches in length shorter, to be employed. For instance, a typical height of a patio heater measured from the top down to ground level can be approximately 91 or 93 inches in length, so that the head 24 herein can extend for approximately equal or greater than one-quarter or 25% of the total length of the patio heater 10. Such a patio heater will have the weight of the head 24 better distributed down along the length of the heater 10 so as to be more resistant to tipping as opposed to prior patio heaters that have this heating head weight more concentrated toward the top of the apparatus and higher up along a longer support pole therefor.

FIG. 4 depicts an alternative configuration of housing 240 in which the undulated outer wall 310 is formed with peaks or raised portions 320 having rounded tips and intervening lands 330 contacting the outer surface 37*a* of inner wall 37 such as described in FIG. 3.

Referring to FIG. 2, the inner wall 37 and insulative layer 39 form part of a subassembly 350 having a closed bottom 340 which is vertically spaced above the burner assembly 22. The inner wall 37 and outer wall 31 of the housing 24 are centered about the longitudinal axis 10*a*. The combustion gases 220 rise up from burner assembly 22 and pass up through the spaces or annuluses 33, defined between the inner wall 37 and undulated outer wall 31.

The outer wall 31 of the housing 24 may be mechanically formed, e.g., die stamped, from a metal sheet roll or metal sheet blank to impart the desired undulated shape, in which the metal sheeting has an outer (exterior) layer possessing high emissivities corresponding to the infrared region of the electromagnetic spectrum.

In one implementation, aluminized steel is used as the outer wall material of outer wall 31. Aluminized steel is aluminum coated steel. A thin aluminum layer can be formed on a steel substrate sheet to form the material structure of outer wall 31 for example, by hot dip coating, to effective provide a continuous aluminum layer of desired thickness thereon. FIGS. 3 and 4 indicate such an aluminum film 35 formed on a stainless steel substrate 35 to constitute outer wall 31. The aluminum layer can be formed of pure or essentially pure aluminum (i.e., >99% purity), or an aluminum alloy such as aluminum-silicon, having emissivity properties consistent with the objectives of this invention. That is, the exterior surface material 35 of the outer wall 31 will have high emissivities in the infrared region of the electromagnetic spectrum.

The substrate steel 36 must have sufficient corrosion resistance to tolerate ambient outdoor conditions for an extended period of service. For instance, cold or hot rolled steels meeting this requirement can be used. The steel substrate sheet generally is 7 gauge or lighter thickness for ease of forming, although thicker members are not excluded either. The steel substrate sheet can be selected to be a stainless steel sheet material. Stainless steels are recognized for enhanced corrosion and oxidation resistance. 300 or 400 series stainless steels, for example, can be used as a stainless steel type substrate sheeting. In one aspect, the metal substrates which are aluminized or carburized are generally flat and smooth-surfaced sheets as visually noticeable surface irregularities usually will not impact the performance of the heater, but may be an aesthetic detraction.

In a more particular embodiment, an aluminized steel outer wall 31 is used that is formed by hot dip coating a stainless steel sheet with molten aluminum-silicon alloy by a conventional continuous method used for this purpose. The aluminum-silicon alloy becomes metallurgically bonded to the stainless steel substrate. The aluminum-silicon alloy can contain, for instance, approximately 91 wt. % aluminum and approximately 9 wt % silicon. The steel sheet is coated on at least one side, so that a coated side is available to serve as the exterior side of the outer wall, after the aluminized steel is stamped or otherwise formed into the desired undulated shape. One side of the stainless steel sheet, which ultimately would represent the inside surface 31*c* of the outer wall, could be masked during the dipping process hut this is not required.

In one aspect, the stainless sheet is unmasked on either side such that the hot dip coating process provides a tightly adherent, uniform coating on both sides of the steel substrate. The thickness of the aluminum layer provided on a commercially acquired sheet of aluminized steel optionally can be increased before use in this invention, such as by plasma spraying, arc spraying, and so forth, aluminum upon the outer surface of the steel sheet until the desired thickness is achieved. The thin aluminum-silicon alloy layer formed on the stainless steel sheet will accommodate forming procedures without incurring significant damage to the coating.

Because the outer surface of the aluminum also can oxidize when exposed to the elements, in one preferred embodiment at least one ounce of aluminum is coated per square foot of the steel sheet. Aluminized steel Type 1 Stainless 409 and 439 are commercially available in a coating weight of 0.25 oz./ft$^2$ minimum. This application rate helps ensure sufficient non-oxidized aluminum remains available as an infrared radiator when the heater is in service. Aluminized steel type 1 stainless 409 and 439 are commercially available in overall thickness from about 0.018 inch (about 0.46 mm) to about 0.080 inch (2.03 mm). Also, ASTM A463 is another grade of aluminized steel that can be used in the practice of the invention. In general, the steel substrate sheet can have a thickness of ranging from approximately 0.01 to approximately 0.10 inch, and the aluminum or aluminum alloy layer has a thickness of approximately 0.0005 to approximately 0.0020 inch.

In an alternative implementation, the exterior surface regions of a steel substrate sheet to be used in making the outer wall of the burner can be carburized to provide a surface skin or region having high emissivity properties in the infrared region of the electromagnetic spectrum. As well known, the carburization process diffuses carbon into the surface of steel during a carburization procedure to produce parts with a wear resistant exterior when hardened. During a carburization process, a carbon source is provided at the surface region of the steel part such that iron (Fe) in the steel surface combines with the carbon to form $Fe_3C$ in the surface of the steel. This absorption of carbon alters the emissivity property of the steel surface, such that is corresponds more with the infrared region of the electromagnetic spectrum.

In another aspect of outer wall 31, a carburized steel sheet is instead used as the outer burner wall material 35, which has been manufactured by a common carburizing method such as pack carburizing, gas carburizing, and liquid carburizing. Alloy steels with low carbon content as well as low carbon steels can be used as the steel substrates that are carburized by such carburizing methods. As known in the field, some alloys, such as those containing nickel, tend to retard the absorption of carbon. Therefore, the time required to produce a given carburized thickness 35 at the surface of the steel substrate sheet 36 generally will vary with the composition of the metal. The extent of carburization, i.e., the depth to which the carbon penetrates into the steel, can be controlled by proper management of the time, temperature, and carbon potential parameters, as understood in the metal processing field.

For example, when metal sheets are carburized by pack carburizing, the carbon steel substrate is "soaked" in a sealed container containing a carbon-rich source and placed in a heated furnace, which forms carbon monoxide in the container that reacts with gamma iron in the sheet surface. The depth to which the carbon penetrates the steel sheet depends on the length of the soaking period. For instance, when carbon steel is soaked in this manner for about eight hours, the carbon penetration often reaches to a depth of about 0.062 inch.

In another aspect, the outer wall 31 of the heater housing 24 can be formed entirely of aluminum in the practice of this invention. Aluminum has excellent corrosion resistance. Nonetheless, aluminized steel is very useful because of the additional structural strength, robustness and rigidity that the steel substrate lends to the wall structure, as well as the cost savings obtained as it tends to be less expensive than a wall structure of sufficient strength and rigidity made entirely of aluminum. Stainless steel in particular is a highly useful steel substrate metal for the aluminum coating as it combines good structural strength and corrosion resistance when exposed to the elements.

The aluminized or carburized steel sheets can be formed into the desire undulated shape of the outer wall of the burner by any convenient forming procedure and suitable forming machinery, such as die-stamping. The die-stamping can be formed before or after the high IR emissivity surface layer 35 is formed. It generally is more convenient to die-stamp in the undulations after forming the surface layer 35 on the substrate metal sheet 36.

In one aspect, the corrugations or other periodic undulations are formed in the metal sheets or sheeting such that the flutes or other upraised portions of regular periodicity have substantially consistent sizes, one to the other, and the intervening lands have generally the same width. The lands, e.g., the inward facing tips located between adjacent outward facing projections, can have relatively narrow width, such as illustrated in FIGS. 3 and 4. The metal sheets used in constructing the outer wall 31 can be cut or stamped into discrete blanks, before after the shaping or forming operation.

The metal blanks are rolled and joined at mated opposing ends to form a closed cylindrical shape with an aluminized or carburized surface 35 facing radially outward. To accomplish this, the outer surface 37*a* of the inner wall structure 37 can be used as a mandrel about which the metal sheet blank is wrapped. The outer wall is joined to the inner wall at one or more of the lands. This joinder can be accomplished using adhesive bonding, welding, soldering, mechanical attachment means, and so forth at the lands of the outer wall. As mechanical attachment means, the outer wall could be physically positioned around the inner wall, and then the two parts can be clamped together at locations at their respective ends where the adjoining parts are exposed at their tops and/or bottoms. The outer surface of the inner wall and inner diameter of the outer wall are respectively sized to just touch and be approximately flush with one another.

The benefit of providing a radiant heater which generates a high proportion of radiant energy in the IR region can be explained as follows. The human body includes a variety of dipolar substances, such as water, fats, proteins, and so forth, that have absorptivities in the infrared wavelength band of the electromagnetic spectrum, including the far infrared wavelengths. Also, many clothes contain materials, such as dyes for instance, having absorptivities in the infrared wavelength range. The absorbed infrared radiation is converted into heat by such IR absorbers. The patio or built-in heaters in accordance with the present invention exploit this circumstance by emitting electromagnetic radiation which is predominantly infrared. In this way, a person situated near the patio heater of the present invention can experience a sensation of warmth in a more energy efficient manner. For instance, the infrared heaters of this invention directly and efficiently warm persons located adjacent the heater without the necessity of heating them via less efficient methods such as by conduction or convection of heated air.

In one aspect, the heating apparatus in accordance with this invention emits radiant energy that is predominantly (>approximately 50%) of infrared wavelength from an exterior surface 35 thereof. The IR band of the electromagnetic spectrum ranges from wavelengths of 0.7 μm to 1000 μm in wavelength. Moreover, the heating apparatus 10 including the housing 24 can emit large amounts of IR in the longer IR wavelengths that are particularly associated with thermal radiation. For instance, the heating apparatus, when heated, can emit radiant energy of which at least 25%, or 50%, or even 75%, is in wavelengths of 10 μm to 100 μm of the electromagnetic spectrum.

In addition, the undulated outer wall configuration 31 of the emitter surfaces of the heating apparatus 10 effectively provide an increased amount heated surface area available for emitting radiant heat into the surrounding area 30, as compared, for example, to a cylindrical or frustoconical shape for instance. In addition, the outer wall 31 is essentially or totally non-foraminous such that it has a total surface area comprised of greater than 90%, or even 99%, by solid material. That is, outer wall 24 does not have a significant number of through-holes in it, unlike the screen-type emitter surfaces of conventional prior patio heaters.

In addition, the use of a solid, non-foraminous or essentially non-foraminous outer wail construction 31 also creates the narrow enclosed annuluses or isolated flue chambers 33*a–n* between the inner wall 37 and outer wall 31 of the emitter system 25 which are relatively small in cross-section, which helps create turbulent, non-laminar flow in the combustion gases as they pass upward through the annuluses away from the burner assembly, as previously discussed. The turbulent flow created in the hot combustion gases increases the amount of heat transfer from the gases to the outer wall. As the annuluses provided for channeling combustion gases up through the housing are relatively narrow and air-tight, and not wide in cross-section, the hot combustion gases have no or little opportunity to spread out and assume a laminar flow profile as they are funneled up the individual annuluses until escaping at the respective open tops of the annuluses located immediately below the reflector dome or lid.

Higher energy efficiencies are achieved by the heating apparatus 10 in accordance with the present invention. As a result, the feed rate of the fuel, e.g. propane, to the burner assembly can be reduced while achieving the same amount of radiant heat generation, as conventional designs having lower efficiencies and thus would require a higher gas feed rate to obtain the same amount of heating effect. In one aspect, the heating apparatus including the unique housing 24 of emitter system 25, when heated via the burner assembly 22, emits 30% or more of heat input into the heater apparatus as radiant energy in the infrared (IR) region of the electromagnetic spectrum. Also, while a conventional patio heater may require about 40,000 BTU/hr energy input to provide a given amount of area heating, the heating apparatus 10 in accordance with the present invention may require only about half, i.e., about 20,000 BTU/hr, of energy input to achieve the same heating effect. The heating efficiency can be determined as the ratio of the actual heat output of the heater divided by the heat input (i.e., the theoretical heat potential of the feed gas when mixed with sufficient air for complete combustion). For this calculation, the heat inputs and outputs can be measured in units of BTU/hr. In this way, the heating apparatus 10 in accordance with the present invention can provide savings in energy costs associated with operating the device.

Additionally, the gas orifice sizes in the conventional burners of patio heaters generally can be around 48 gauge, while in the present apparatus 10, the orifice sizes used in burner 22 can be smaller such as about 52 or 54 gauge, due to the increased heating efficiencies it provides. The gas input to the burner assembly 22 is matched with sufficient air to get as close to 100% combustion as possible.

The heating apparatus in accordance with the present invention also is highly versatile. It can be used indoors or outdoors. It can be used in a free-standing version, such as illustrated above, or as built-in configurations.

Other features, although not required, that can add convenience to the heating apparatus 10 include the following. The heating apparatus 10 can be made of a construction that is readily broken down so that it can be stored and shipped in a compact and cost-efficient manner. The standard or vertical pole 14 for the apparatus can be provided in two equal length pole sections with swedges formed at ends of the sections for forming a detachable connection therebetween. Further detachable connections similar to that between pole sections can be provided at the top 32 of the standard 14 between it and the housing 24, and at the bottom 48 of the standard 14 where it is tightly received in a central recess 50 formed at the top of the base 12.

The gas feed line 20 can be of a flexible aluminum material, such 18, for example, in the form of an aluminum line having a ⅜ inch diameter with a wall thickness of 0.032 inches, so that it can be coiled for placement into the cut-out or hollow interior 16 of the base 12. Accordingly, where the base 12 is sized to fit a 20 lb. LP cylinder 18, it preferably will have a diameter at the bottom of its support flange 13 of approximately 20–60 inches, as previously mentioned. In this form, the apparatus 10 preferably will have a height from the bottom to the juncture of the heating head 24 and cover member 26 of approximately 86 inches, and the outer diameter of the cover member preferably can be less than 2.5 feet in length or approximately 26 inches.

Returning to FIG. 1, the burner assembly 22 and controls therefor will next be described in more detail. A control panel 52 is provided and includes an ignitor actuator 54 and a gas valve control knob 56 mounted thereon. The control panel 52 can be disposed in a cutout 58 formed at upper corner of the base 12 so that the control panel 52 is recessed therein and accessible from outside the base 12. Alternatively, the panel 52 can be provided higher up along the pole 14 at 60 just below the heating head 24. Burner assembly 22 includes a burner head fed gas from fuel tank 18 via gas line 20 with the gas flow being regulated by the valve control 56. An ignitor element (not shown), which can be of conventional design for this purpose, such as a piezoelectric ignitor actuator, is depressed. A standard safety shut off (not shown) usually is provided as controlled by thermocouple in a conventional manner, which is sensitive to temperature variations, and will cause an open gas valve (not shown) to close if the pilot flame in the burner assembly 22 is extinguished for any reason with the gas valve control turned on. These features and others related to the operation of a patio heater burner assembly which are applicable to the burner assembly 22 herein are described in further detail in U.S. Pat. No. 6,102,031, which descriptions and related figures are incorporated herein by reference. Again, an advantage of the present invention is that the non-foraminous structure used for housing 24 effectively reduces if not prevents flame out problems from occurring due to wind.

Also, to enhance the functioning of the previously-described fuel efficiency systems 25, a motion sensor (not shown) could be provided for controlling the ignition of fuel by the burner assembly 22. The motion sensor would detect the motion of people about the apparatus so that if no one is present, there is no ignition of fuel by the burner assembly 22, and thus there is no fuel wasted for providing heating when none is needed. Similarly, when the motion sensor would detect the presence of people as by their movement, the sensor would cause the ignition of fuel by the burner assembly to provide heating and warmth for the people about the apparatus. Such a motion sensor could be disposed in an enlarged lower valve housing extension of the burner assembly housing between it and the top of the standard, such as described in U.S. Pat. No. 6,102,031, which descriptions and related figures are incorporated herein by reference.

As previously-discussed, the patio heaters described herein are oftentimes used by taverns and bars where no-smoking laws make patrons go outdoors to smoke. As such, these heaters are primarily for nighttime outdoor use. Accordingly, lighting about patio heaters is a significant concern. In this regard, a light such as gas light also could provided in conjunction with heating apparatus 10, such as generally described in U.S. Pat. No. 6,102,031, which descriptions and related figures are incorporated herein by reference. Such a gas light could be mounted at various locations on the apparatus 10 such as between the housing 24 and the reflector 26, and could be fed with fuel from the same source that feeds fuel to the burner assembly for illuminating the area about the apparatus 10 that is warmed thereby. In this manner, patrons standing about the apparatus 10 have an area that is well-lit and at a comfortable temperature providing conditions similar to that found indoors.

Also, a tip switch can be included such as in the form of a mercury switch that can sense when the apparatus 10 tips a predetermined amount, such as described in U.S. Pat. No. 6,102,031, which descriptions and related figures are incorporated herein by reference. When this tipped condition is detected, the switch would interrupt the signal from the thermocouple holding the gas valve open so as to shut off the apparatus 10. Thus, if the apparatus 10 is tipped over, the heater will not stay on as the tip mercury switch would cause the gas valve to close for shutting down apparatus 10.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

I claim:

1. A heating apparatus comprising:

a heating head for emanating heat thereabout and having a central, longitudinal axis extending therethrough;

a burner assembly for igniting fuel from a fuel source and generating hot combustion gases;

a plurality of elongate flue chambers extending along the head axis through which the hot combustion gases travel;

external and internal wall portions of the head that are of a predetermined material and cooperate to form the flue chambers; and insulation material that is distinct from the material of the wall portions disposed against and along the head internal wall portions so that the insulation material maximizes heat transfer from the hot combustion gases radially outward to the external wall portions and minimizes heat transfer radially inward from the inner wall portions.

2. The heating apparatus of claim 1 wherein the external and internal wall portions are spaced to keep the flue chambers sized to provide for turbulent flow of the combustion gases traveling therethrough.

3. The heating apparatus of claim 1 wherein the head is sized along the axis thereof and the head outer wall portions are of a predetermined material selected to radiate substantially infrared heat energy.

4. The heating apparatus of claim 1 including an elongate support on which the head is mounted so that the central axis thereof is aligned with the support to provide the heating apparatus as a patio heater of a predetermined axial length with the head above ground level.

5. The heating apparatus of claim 4 wherein the head has a predetermined length equal or greater than approximately one quarter of the predetermined length of the patio heater.

6. The heating apparatus of claim 4 including a downwardly opening dome on top of the heating head to reflect stray heat energy downwardly about the head and elongate support therefor.

7. The heating apparatus of claim 1 wherein the external and internal wall portions engage each other to substantially isolate gas flow in each flue chamber from gas flow in other flue chambers.

8. The heating apparatus of claim 7 wherein the head includes an inner, generally cylindrical wall including the inner wall portions, and an outer wall including the outer wall portions and being configured to generally include peaks spaced from the inner wall portions and valleys engaged with the inner wall portions.

9. The heating apparatus of claim 8 wherein the peaks of the outer wall portions are curved or angled.

10. The heating apparatus of claim 8 wherein the inner wall includes an inner surface with the insulation material thereon.

* * * * *